United States Patent [19]

Miller

[11] 4,227,377

[45] Oct. 14, 1980

[54] CONTROL SYSTEM FOR ICE DISPENSER AND METHOD

[75] Inventor: Benjamin D. Miller, Chicago, Ill.

[73] Assignee: Remcor Products Company, Franklin Park, Ill.

[21] Appl. No.: 928,242

[22] Filed: Jul. 26, 1978

[51] Int. Cl.[3] ..... F25C 1/00

[52] U.S. Cl. ..... 62/66; 62/137; 62/233; 222/56; 222/64

[58] Field of Search ..... 62/137, 233, 66; 137/386; 141/1, 2, 18, 82, 102, 198; 222/64, 70, 56, 146 C

[56] References Cited

U.S. PATENT DOCUMENTS

| | | | |
|---|---|---|---|
| 3,211,338 | 10/1965 | Weil et al. | 222/146 C X |
| 3,503,222 | 3/1970 | Dinger et al. | 62/137 |
| 3,913,343 | 10/1975 | Rowland et al. | 62/137 |

*Primary Examiner*—Frederick R. Schmidt

*Attorney, Agent, or Firm*—Gary, Juettner & Pyle

[57] ABSTRACT

A control system for an ice dispenser maintains an icemaker thereof continuously operative whenever an ice storage hopper is less than completely full. This is accomplished by continuing to operate the icemaker while momentarily agitating and leveling the mass of ice in the hopper whenever ice builds up around a thermostat therein, and thereafter sensing whether the ice has dropped away from the thermostat. If it has, the icemaker is maintained in operation and the cycle is repeated. If, however, it has not, then the icemaker is turned off until sufficient ice is dispensed from the hopper to again drop the ice level to below the thermostat. In this manner, the number of on-off cycles of the compressor and other components of the icemaker are minimized in maintaining the hopper completely full, which greatly increases their operating life and reliability.

9 Claims, 3 Drawing Figures

CONTROL SYSTEM FOR ICE DISPENSER AND METHOD

BACKGROUND OF THE INVENTION

The present invention relates to control systems for ice dispensers, and in particular to an improved control system for an ice dispenser which maintains an icemaker thereof continuously operative whenever an ice storage hopper is less than completely full.

In the food and beverage service industries it is desirable to provide means for expeditiously dispensing a quantity of ice, for example into a glass to facilitate service of ice water and cold beverages to customers. Conventionally the means comprises an ice dispenser, which for commercial application usually includes a hopper for storing a quantity of crushed, cracked, flaked or cubed ice, an icemaker for manufacturing ice for the hopper, a thermostat on the hopper in proximity to the point of entry of ice for sensing the level of ice, and an agitator for the mass of ice to prevent congealing or agglomeration in order to maintain the ice particles in discrete free flowing from. An opening at the bottom of the hopper enables ice to be removed from the hopper, for example by a dispensing unit which automatically provides a measured quantity of ice.

The thermostat is positioned at the point of entrance of ice into the hopper to prevent overfilling, and therefore ice tends to build up around the thermostat. As a result, ice may trip the thermostat when the hopper is only partially full. In conventional control schemes, actuation of the thermostat stops the icemaker and operates the agitator for a timed period to break up and level the mass of ice. If the ice drops away from the thermostat upon agitation, the icemaker is restarted and the cycle is repeated. Ordinarily, in bringing the hopper to a completely full condition the agitator and icemaker are cycled several times before the level of the mass of ice is high enough for ice to remain about the thermostat, whereafter the icemaker remains off until sufficient ice has been dispensed to again drop its level to below the thermostat. A disadvantage of such conventional control schemes is that the icemaker is cycled through a large number of on-off cycles in maintaining the hopper full, so that the compressor and other components thereof are subjected to increased wear and a decreased operating life and reliability.

OBJECT OF THE INVENTION

The primary object of the present invention is to provide an improved control circuit for an ice dispenser, and method of operating an ice dispenser, which continuously operates an icemaker thereof whenever an ice storage hopper is less than completely full, whereby the number of on-off cycles of the icemaker are significantly reduced and its operating life is increased.

SUMMARY OF THE INVENTION

In accordance with the present invention, an improved method of operating an ice dispenser of the type having a hopper for storage of a quantity of ice comprises the steps of introducing ice into an upper end of the hopper; sensing when the ice reaches a selected level in the hopper; agitating the ice in the hopper after it reaches the selected level while continuing to introduce ice into the hopper; and, after agitation, continuing or interrupting introduction of ice into the hopper in accordance with the sensed level thereof being below or at least equal to, respectively, the selected level.

The invention also contemplates an improved control system for an ice dispenser, in which the ice dispenser is the type having a hopper for storage of a quantity of ice, an icemaker for manufacturing and introducing ice into the hopper, a sensor in the hopper for sensing the level of ice therein, and an agitator for breaking up and leveling the mass of ice in the hopper.

In a preferred embodiment of the control system, means are provided, upon occurrence of ice around the sensor, for momentarily operating the agitator to level the mass of ice while continuing to operate the icemaker. Thereafter, if after a period of time the sensor does not sense any ice therearound, operation of the icemaker is continued and the foregoing cycle of operation is repeated. On the other hand, if the sensor still detects ice therearound, which occurs when the hopper is completely full, means are provided for interrupting operation of the icemaker until a sufficient quantity of ice has been dispensed from the hopper to drop the level of the mass of ice to beneath the sensor, whereupon operation of the icemaker is again commenced and the described cycles are repeated.

By virtue of the control system continuing operation of the icemaker for a period of time after first detecting a buildup of ice around the sensor and agitating the ice, and then either continuing or terminating operation of the icemaker in accordance with the absence or presence, respectively, of ice around the sensor, the number of on-off cycles and wear of the compressor and other components of the icemaker are minimized in maintaining the hopper completely full, so that the operating life and reliability of the icemaker are significantly increased.

Other objects, advantages and features of the invention will become apparent upon a consideration of the following detailed description, when taken in conjunction with the accompanying drawings.

DETAILED DESCRIPTION

To acquaint those skilled in the art with the improved control system for an ice dispenser, there is illustrated in the accompanying drawings a preferred embodiment presently contemplated as the best mode of carrying out the invention.

Figure 1:
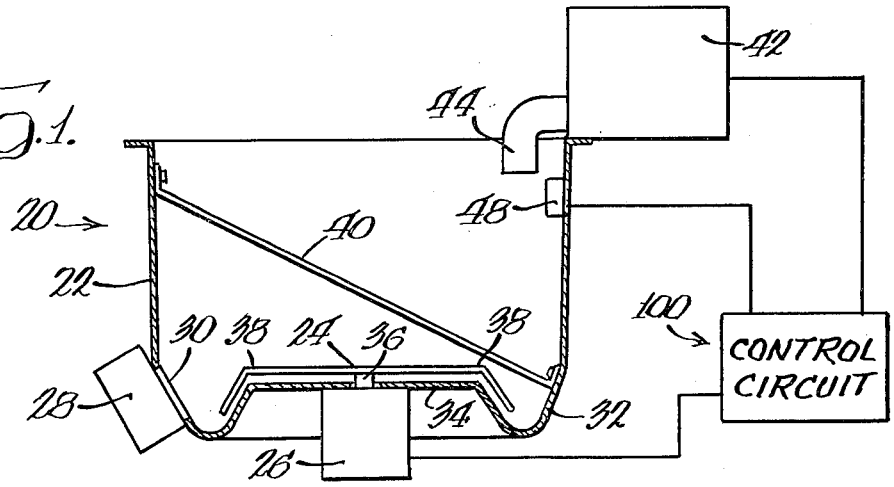
FIG. 1 is a side elevation view, partly in cross section and partly in block diagram form, generally illustrating connection of the control system of the invention with an ice dispenser of conventional construction.

As shown in FIG. 1, an ice dispenser indicated generally at 20 is conventionally comprised of a hopper, bin or tank 22 for storing a large quantity of crushed, cracked, flaked or cubed ice, such as fifty pounds, a rotary impeller or agitator 24 driven by an electric motor 26, and means 28 for accommodating controlled discharge of ice from the lower end portion of the hopper through a discharge opening 30.

The means 28, although not forming a part of the present invention, is highly desirable to enable convenient dispensing of the ice in the hopper, and may take the form of any of the dispensing means disclosed in U.S. Pat. Nos. 3,165,901; 3,211,338 and 3,217,509, to which reference is made for a more detailed description.

The hopper 22 is essentially an open top tub, the major part of which comprises a main upper hopper portion which may be of circular or other cross section, but preferably is of polygonal cross section as disclosed in U.S. Pat. No. 3,517,860 to facilitate maintaining the particles of ice in discrete, free flowing form. The bottom of the hopper is provided with a circular depression comprising an annular trough 32 in which the discharge opening 30 is formed. The opening is spaced a short distance above the bottom of the trough, and the trough is appropriately provided at its bottom with melt water drain holes (not shown) so that only discrete particles of relatively dry ice will be discharged through the opening. The bottom of the hopper is closed by an end wall 34, so that ice to be discharged gravitates into and is confined within the trough.

The hopper may be made in any conventional manner, such as by deep drawing of sheet material or the molding of plastics, and when completed is sheathed in insulation and provided with a removable insulated cover, all as is well known in the art.

The bottom wall 34 of the hopper is centrally apertured for upward, liquid sealed passage therethrough of a shaft 36 of the drive motor 26, the motor being suitable mounted on the wall 34 exteriorly of the hopper. Mounted on the motor shaft 36 within the interior of the hopper is the impeller 24 which has a plurality of radial arms 38 that generally follow the contour of the bottom wall of the hopper and extend into the trough and engage the mass of ice placed in the hopper to cause the same to rotate. A rod 40 extends from side to side and top to bottom within the hopper, and provides a fixed resistance against which the rotating mass of ice may be moved to facilitate agitation and separation thereof into discrete free flowing particles. The motor 26 may comprise an electric gear motor coupled with discharge means 28, such that the motor is operated for a short interval of time during operation of the means 28 in order to provide a free flow of discrete ice particles therethrough.

In order to maintain a supply of ice in the hopper 22 and to replenish ice discharged through the means 28, an icemaker 42 has an ice outlet or ice discharge spout 44 in communication with the open upper end of the hopper. The icemaker may be of any conventional type, and provides crushed, cracked, flaked or cubed ice to the hopper. Although the icemaker is shown positioned at the upper end of the hopper, the actual positioning of the icemaker is not critical to the invention and the icemaker may be mounted in any convenient location, for example below the hopper with ice provided thereby being carried into the hopper by any convenient means, such as by a spiral drive.

To control operation of the icemaker in order to maintain ice in the hopper at a selected level, a thermostat 48 is mounted on an inside wall of the hopper in proximity with the ice spout 44 and at the level at which the ice is to be maintained, and senses the presence or absence of ice therearound by means of the surrounding temperature. Since as ice fills the hopper it tends to build up higher in the hopper near its point of entrance, by positioning the thermostat thereat overfilling of the hopper is prevented.

The thermostat is connected with a control system for operating the icemaker and the agitator. In a conventional control scheme, upon a buildup of ice occurring around the thermostat the icemaker is turned off and the agitator motor is energized for a predetermined period to rotate the agitator and level the mass of ice within the hopper. If the hopper is less than completely full, upon leveling it drops away from the thermostat, whereupon the icemaker again operates. Since ice builds up faster near its point of entrance in the hopper, sensing of ice by the thermostat and cyclic operation of the icemaker and agitator motor occur several times until the overall level of the ice in the hopper is high enough that ice remains about the thermostat after agitation, whereupon the icemaker remains off until sufficient ice is discharged from the hopper to drop its level to beneath the thermostat. In consequence, the icemaker cycles on and off a number of times during each complete filling of the hopper, and the compressor and other components of the icemaker suffer increased wear and a decreased operating life and reliability.

In accordance with the present invention, an improved control system for an ice dispenser provides for continuous operation of the icemaker whenever it is necessary to fill the hopper and until the hopper is completely full. As a result, in use of the dispenser the icemaker is cycled on and off a minimum number of times, and the operating life of the icemaker is significantly extended.

Figure 2:
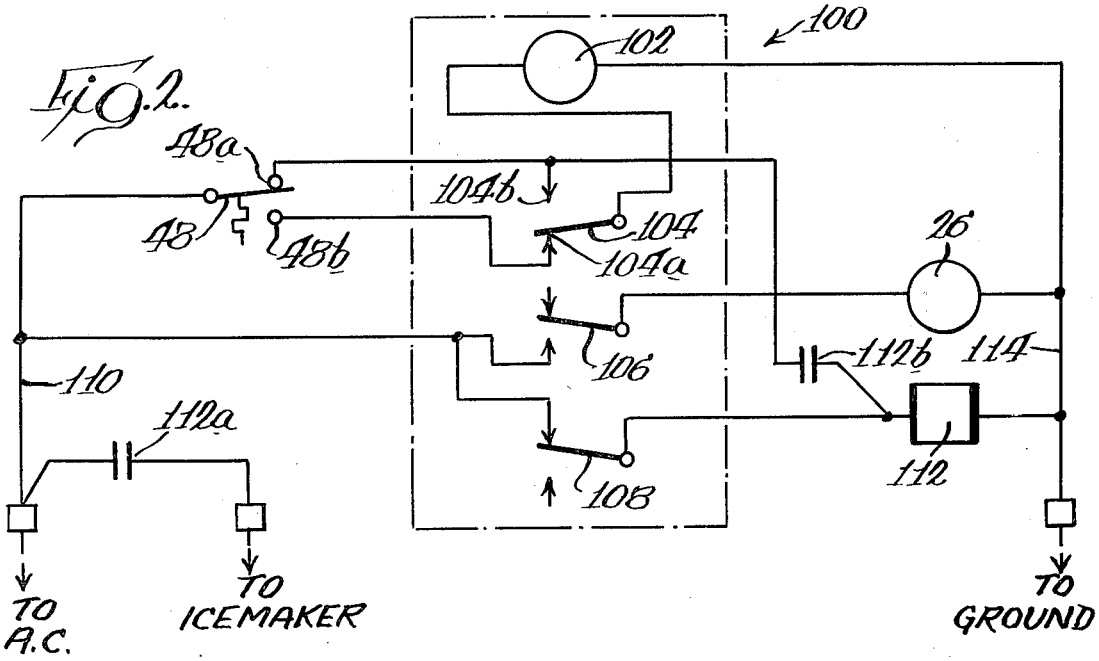
FIG. 2 is a schematic circuit representation of a preferred embodiment of the control circuit.

More particularly, the improved control system of the invention is indicated generally at 100 and shown diagrammatically in FIG. 1 and schematically in FIG. 2. With reference to FIG. 2, the control system 100 includes a timer motor 102 which, when energized, operates three switches 104, 106 and 108 in a timed, sequential and preselected manner, for example through cam and cam follower arrangements. One such timer motor and switch structure which has been found to be suitable in the practice of the invention is sold by Zenith Controls, Inc. as a Series RWM, in which a timer motor is arranged to operate a plurality of switches through cams and cam followers. It is understood, however, that it is the particular sequence of operation and the function served by the switches that is the essence of the invention, as will be described, and that any suitable means may be used for accomplishing the switching function.

The contacts of the thermostat 48 and the control circuit 100 are shown in FIG. 2 in their normal or ice making position. Under this condition, an a.c. voltage on a line 110 passes through the switch 108 to one side of a relay 112, the other side of which is connected to ground on a line 114. This energizes the relay, whereby a contact **112*a* thereof is closed to apply the voltage on the line 110 to the icemaker to continuously operate the same, and a contact 112*b* is closed so that the relay also receives the a.c. voltage through an alternate circuit including a contact terminal 48*a* of the thermostat. Also under this condition the switch 106 is open so that the agitator motor 26 is off, and the timer motor 102** is deenergized.

Figure 3:
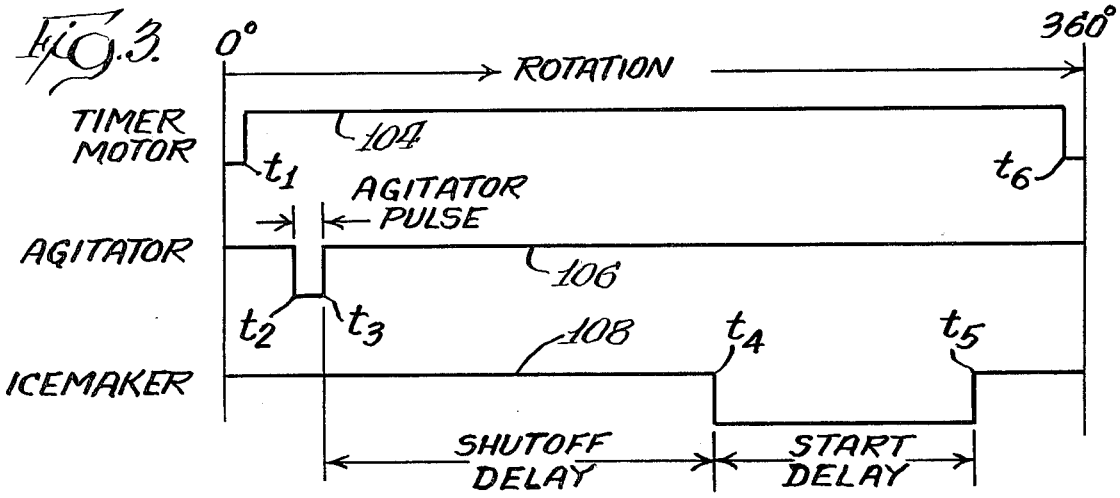
FIG. 3 is a timing chart graphically illustrating the operating sequence of the various components of the control system.

Upon occurrence of a buildup of ice around the thermostat 48, the thermostat switches its state to disconnect the a.c. voltage from the contact **48*a* and apply the voltage to a second contact 48*b* thereof. This contacts the voltage to the timer motor 102 through a contact 104*a* of the switch 104 to start the motor. With reference also to FIG. 3, at a time $t_1$ after operation of the timer motor the switch 104 changes state, whereupon the timer motor continues to operate as a result of an a.c. voltage received at the contact 104***b* through the switch 108 and the relay contact 112*b*. Then, at a time $t_2$ and for a short period of about three seconds until a time $t_3$, the switch 106 closes to momentarily energize the agitator motor 26 to rotate the agitator 24 in order to level the surface of the mass of ice in the hopper 22. If as a result of leveling the ice drops away from the thermostat 48 during an icemaker shutoff delay of about three minutes from the time $t_3$ to a time $t_4$, then prior to the time $t_4$ when the switch 108 opens and would otherwise deenergize the relay 112, the thermostat will return to its original state and provide the a.c. voltage to both the contact 104*b* and the relay 112 through the relay contact 112*b*. In this manner, upon opening of the switch 108 at the time $t_4$ and until the time $t_5$ the relay 112 will remain energized, and the timer motor 102 and the icemaker 42 will continue to run. Thereafter, at a time $t_6$ the switch 104 returns to its original state and the timer motor stops.

The above described sequence of operation of the thermostat 48 and the control circuit 100 was directed to the situation where ice had built up around the thermostat, but the hopper was not yet completely full, so that after agitation the level of ice in the hopper dropped beneath the thermostat. Under that condition the icemaker was not shut off, but instead ran continuously in order to minimize wear of its components. Had the hopper been completely full at the time a buildup of ice occurred around the thermostat, however, then after agitation and leveling ice would still be present about the thermostat. Under this condition, the thermostat would not return to its original state, and at the time $t_4$ would continue to apply the a.c. voltage on the line 110 to the contact 48*b*. Therefore, opening of the switch 108 at the time $t_4$ would cause the relay 112 to deenergize and the relay contacts 112*a* and 112*b* to open. Upon opening of the relay contacts, the icemaker 42 and the timer motor 102 are stopped.

The timer motor 102 and the icemaker 42 then remain off for as long as sufficient ice remains in the hopper 22 to be about the thermostat 48, and the control system 100 remains in the condition graphically illustrated at the time $t_4$ in FIG. 3. Upon a sufficient quantity of ice being dispensed from the hopper, however, the ice drops down away from the thermostat, and the thermostat switches states and connects the a.c. voltage on the line 110 with the contact 48*a*. When this occurs the timer motor is again energized through the contact 104*b*, but the icemaker remains off since the relay 112 cannot be energized through the now open contact 112*b* and switch 108. With continued operation of the timer motor, at the time $t_5$ after an icemaker start delay of about two minutes from the time $t_4$ to the time $t_5$, the switch 108 again closes and energizes the relay 112, whereupon the contacts 112*a* and 112*b* close to operate the icemaker. Thereafter, at the time $t_6$ the switch 104 returns to its original state and the timer motor 102 is deenergized until such time as ice again builds up around the thermostat.

The invention thus provides an improved control system for an ice dispenser, which enables the icemaker to operate continuously whenever and for as long as the storage hopper is less than completely full, so that the icemaker turns off only when the hopper is completely full. In this manner, a readily available and maximum supply of ice is always maintained in the hopper, yet the severe conditions of cycling the icemaker on and off are minimized. Thus, the operating life and reliability of the icemaker components are significantly increased, and down time of the ice dispenser for repair and/or maintenance of components is minimized.

While one embodiment of the invention has been described in detail, various modifications and other embodiments thereof may be devised by one skilled in the art without departing from the spirit and the scope of the invention, as defined by the appended claims.

What is claimed is:

1. A method of operating an ice dispenser of the type having a hopper for storage of a mass of small particles of ice, comprising the steps of introducing ice into an upper end of the hopper; sensing when ice reaches a selected level in the hopper; commencing timing of a predetermined time interval in response to the sensed level of ice reaching the selected level; agitating the mass of ice in the hopper after ice reaches said selected level and during said timing step while continuing to introduce ice into the hopper; and, after agitation and at the expiration of the predetermined interval, continuing or interrupting introduction of ice into the hopper in accordance with the sensed level thereof being below or at least equal to, respectively, said selected level said timing step comprising timing first and second discrete periods of time which together equal the predetermined time interval, said agitating step comprising agitating the ice for the first period of time after it reaches said selected level; said continuing or interrupting step comprising sensing whether the ice is at said selected level at the end of the second period time following the first period, and continuing or interrupting said manufacturing and introducing steps in accordance therewith.

2. A method as in claim 1, including the step of manufacturing ice for introduction into the hopper, said manufacturing step being continued or interrupted in accordance with said introducing step being continued or interrupted, respectively, said sensing step comprising sensing when ice reaches said selected level in the hopper in an area in proximity with its point of entry into the hopper.

3. A method as in claim 2, including the step, upon said manufacturing and introducing steps being interrupted at the end of said second period of time, of again continuing said manufacturing and introducing steps following a subsequent sensed level of ice below said selected level.

4. A method as in claim 3, said step of again continuing said manufacturing and introducing steps occurring after a third period of time following said subsequent sensed level of ice below said selected level.

5. A method of operating an ice dispenser of the type having a hopper for storage of a mass of small particles of ice, comprising the steps of manufacturing and introducing ice into an upper end of the hopper; sensing when the level of ice in the hopper in an area in proximity with its point of entry into the hopper reaches a selected level; commencing timing of a predetermined time interval, which comprises first, second and third discrete periods of time, immediately upon the sensed level of ice reaching the selected level; agitating the mass of ice in the hopper for the first period of time while continuing said manufacturing and introducing step for the second period of time immediately following said first period; continuing or interrupting said manufacturing and introducing step at the end of the second period in accordance with the sensed level of ice being below or at least equal to, respectively, said selected level; upon the occurrence of interruption of said manufacturing and introducing steps at the end of the second period, again commencing said manufacturing and introducing steps after the third period of time immediately following a subsequent sensed level of ice below said selected level; and repeating the above steps, whereby said manufacturing and introducing step is performed continuously whenever the overall level of the mass of ice is less than said selected level.

6. A control system for an ice dispenser of a type having a hopper for storage of a mass of small particles of ice, an agitator for the mass of ice, an icemaker for manufacturing and introducing ice into an upper end of the hopper, and a sensor for sensing the level of ice in the hopper, comprising means for operating the icemaker when the sensed level of ice is below a selected level; timer means for measuring a predetermined time interval which comprises first and second discrete and sequential periods of time; means responsive to said timer means for operating the agitator for the first period of time upon ice reaching said selected level while continuing to operate the icemaker; and means responsive to said timer means and said sensor for continuing or interrupting operation of the icemaker after agitation and at the expiration of the second period of time in accordance with the sensed level of ice at that time being below or at least equal to, respectively, said selected level.

7. A control system as in claim 6, wherein the predetermined interval measured by said timer means also includes a third discrete period of time following the second period, and including means responsive to said timer means and operative upon operation of the icemaker being interrupted at the end of said second pair of time, for again operating the icemaker at the end of the third period of time commencing with a subsequent sensed level of ice below said selected level.

8. A control system for an ice dispenser of a type having a hopper for storage of a mass of small particles of ice, an agitator for the mass of ice, an icemaker for manufacturing and introducing ice into an upper end of the hopper, and a sensor for sensing the level of ice in the hopper in an area in proximity with its point of entry into the hopper, comprising means for operating the icemaker when the sensed level of the ice is below a selected level; timer means for measuring first, second and third discrete periods of time; means responsive to said timer means and the sensor for operating the agitator for the first period of time upon sensing ice at the selected level while continuing to operate the icemaker; means responsive to said timer means for continuing to operate the icemaker for the second period of time upon termination of agitation at the end of the first period; means responsive to said timing means and sensor for continuing or interrupting operation of the icemaker at the end of the second period of time in response to the sensed level of ice being below or at least equal to, respectively, said selected level; and means, responsive to said timer means and sensor upon interruption of the icemaker at the end of the second period of time, for again operating the icemaker at the end of the third period of time following a subsequent sensed level of ice below said selected level, whereby said icemaker is operated continuously whenever the overall level of the mass of ice is below said selected level.

9. A control system as in claim 8, said timer means comprising a timing circuit having a timing motor and a plurality of electrical switches actuable thereby.

* * * * *